US005335910A

United States Patent [19]

Tanzer et al.

[11] Patent Number: 5,335,910

[45] Date of Patent: Aug. 9, 1994

[54] PINBALL MACHINE HAVING A CONVEYOR BELT BALL LIFT

[75] Inventors: Raymond C. Tanzer, Naperville; Peter J. Hanchar, Chicago, both of Ill.

[73] Assignee: Premier Technology, Bensenville, Ill.

[21] Appl. No.: 90,704

[22] Filed: Jul. 13, 1993

[51] Int. Cl.[5] ..... A63F 7/38

[52] U.S. Cl. ..... 273/121 E; 273/119 A; 273/121 A

[58] Field of Search ..... 273/118-121

[56] References Cited

U.S. PATENT DOCUMENTS

| | | | |
|---|---|---|---|
| 3,103,358 | 9/1963 | Holloway . | |
| 3,108,810 | 10/1963 | Wiley, Jr. | 273/120 R |
| 3,132,862 | 5/1964 | Pratt . | |
| 3,179,411 | 4/1965 | Conklin et al. . | |
| 4,354,680 | 10/1982 | Kmiec . | |
| 4,650,190 | 3/1987 | Geiger . | |
| 4,840,375 | 6/1989 | Lawlor et al. | 273/121 E X |
| 4,848,748 | 7/1989 | Krutsch | 273/121 E |
| 4,981,298 | 1/1991 | Lawlor et al. . | |
| 5,112,049 | 5/1992 | Borg . | |
| 5,120,059 | 6/1992 | Oursler | 273/121 A |

FOREIGN PATENT DOCUMENTS 1918731 2/1970 Fed. Rep. of Germany .

*Primary Examiner*—Vincent Millin
*Assistant Examiner*—Raleigh W. Chiu
*Attorney, Agent, or Firm*—Arnold, White & Durkee

[57] ABSTRACT

A pinball elevator has an inclined conveyor belt tensioned between two pulleys and driven by an electric motor. The belt is perforated with a series of spaced circular apertures for receiving the pinball. Preferably, the apertures have a diameter of about 80% of the diameter of the pinball. A lower one of the pulleys is rotatably mounted beneath the playfield of the pinball machine, and an upper one of the pulleys is rotatably mounted above the playfield. The ball is received by the belt at an entrance location, and is ejected from the belt at an exit location. The ball passes above and over the upper pulley when being conveyed by the belt from the entrance location to the exit location. The upper pulley has a concave central region to prevent the pinball from being prematurely ejected from the belt by the upper pulley. At the entrance location, the pinball sits on the belt and abuts against a wall of the playfield. At the exit location, the ball is tangent to the belt around the upper pulley and is tangent to a supporting surface of an elevated exit ramp.

16 Claims, 10 Drawing Sheets

PINBALL MACHINE HAVING A CONVEYOR BELT BALL LIFT

RELATED APPLICATIONS

The present application contains disclosure that is similar to disclosure in a U.S. patent application by Raymond C. Tanzer entitled "Pinball Machine Having an Interactive Playfield," filed coincident with the filling of the present application.

BACKGROUND OF THE INVENTION

1. Field of the Invention

The present invention relates generally to pinball machines, and more particularly to an interactive game feature. The present invention specifically relates to a ball lift for elevating a pinball in a pinball machine.

2. Background Art

A pinball game has an inclined playfield and a plurality of play features arranged on the playfield. A player operates flippers to direct a ball at playfield features such as targets or ramps to score points. The configuration of the playfield features may change as a result of the presence of the ball. Drop targets, for example, drop beneath the playfield when struck by the ball.

Pinball games have used a ball lift that operates on the principle of the Archimedes' screw. The ball is guided in a ramp parallel to the axis of the screw, while the ball is pushed or lifted by the screw.

A ball elevator for a pinball game must be reliable and easy to manufacture. Moreover, the ball elevator should captivate the player's attention during the time required to lift the ball.

SUMMARY OF THE INVENTION

Briefly, in accordance with a basic method of the present invention, a pinball is elevated in a pinball machine by the steps of: (a) driving an inclined conveyor belt with a motor, the conveyor belt having a series of spaced apertures for receiving the pinball; (b) directing the pinball to a predefined entrance position where the pinball becomes engaged by one of the apertures in the conveyor belt and elevated by movement of the belt; and (c) receiving the pinball from the conveyor belt at a predefined exit position that is elevated with respect to the entrance position.

In accordance with another aspect, the invention provides a ball elevator in a pinball machine including an inclined conveyor belt mounted for elevating a pinball from an entrance location to an exit location, and a motor coupled to the conveyor belt for driving the conveyor belt to elevate the pinball. Preferably the conveyor belt is an endless strip of flexible material, the conveyor belt is perforated with apertures for receiving the pinball, and the apertures are circular and have a diameter of about 80% of the diameter of the pinball.

In accordance with yet another aspect, the invention provides a pinball machine including a playfield having a plurality of ball-deflecting components mounted thereon, means for projecting a pinball over the playfield, and an inclined conveyor belt for elevating the pinball from a predefined entrance location to a predefined exit location. The conveyor belt is an endless band of flexible material, and has a series of spaced aperture for receiving the pinball. The conveyor belt is tensioned between two pulleys. A lower one of the pulleys is rotatably mounted to the playfield at a location below the playfield, and an upper one of the pulleys is rotatably mounted to the playfield at a location above the playfield. An electric motor is mounted to the playfield and has a shaft coupled to one of the pulleys for driving the conveyor belt to elevate the pinball. In a preferred construction, the pinball passes above and over the upper pulley when being conveyed by the belt from the entrance location to the exit location. The upper pulley has a concave central region to prevent the pinball from being prematurely ejected from the belt by the upper pulley. At the entrance location, the pinball sits on the belt and abuts against a wall of the playfield. At the exit location, the ball is tangent to the belt around the upper pulley and is tangent to a supporting surface of an elevated exit ramp.

BRIEF DESCRIPTION OF THE DRAWINGS

Other objects and advantages of the invention will become apparent upon reading the following detailed description with reference to the accompanying drawings wherein.

Figure 1:
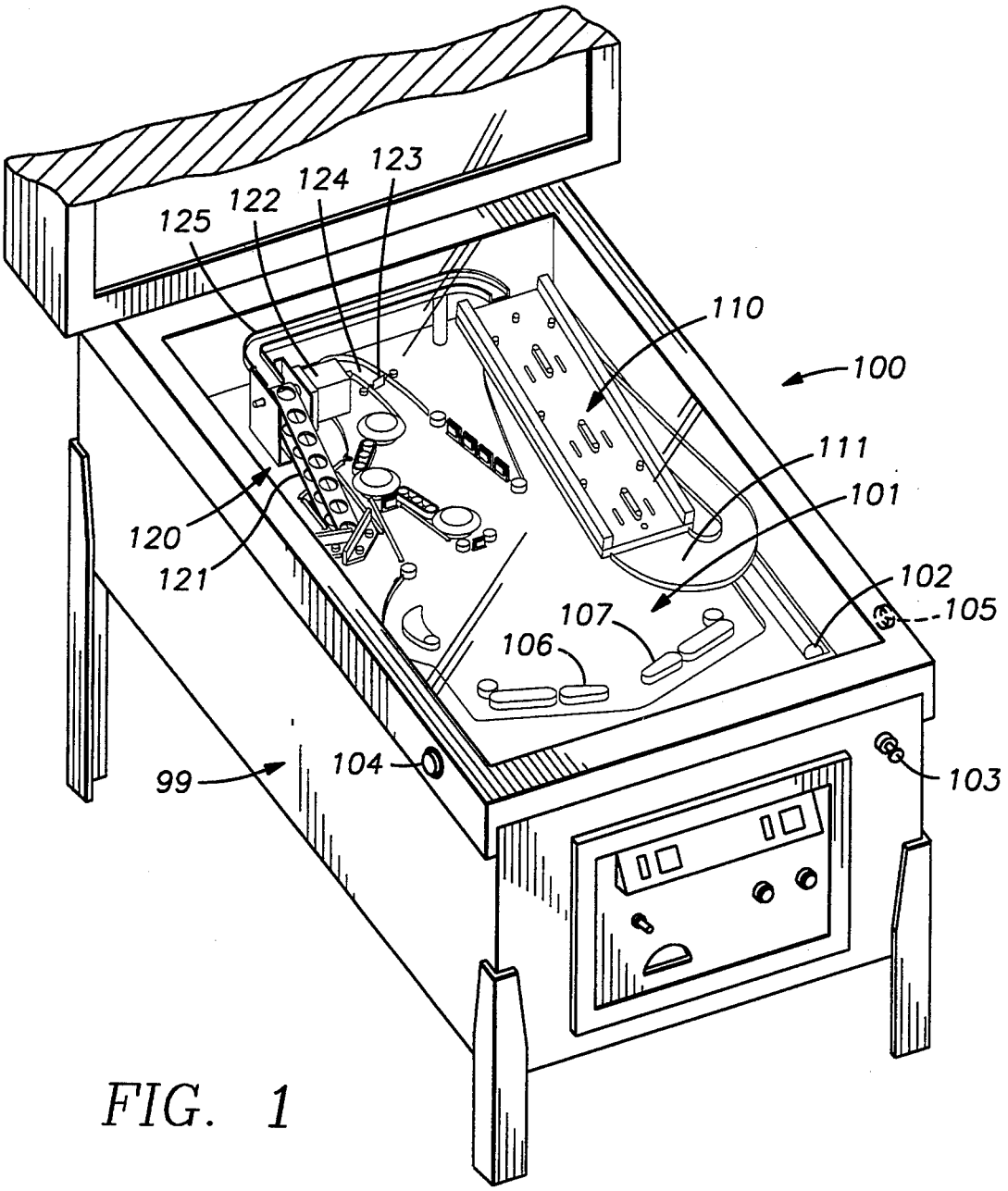
FIG. 1 is a perspective view of a pinball machine incorporating the present invention.

While the invention is susceptible to various modifications and alternative forms, a specific embodiment thereof has been shown in the drawings and will be described in detail. It should be understood, however, that it is not intended to limit the invention to the particular form shown, but on the contrary, the intention is to cover all modifications, equivalents, and alternatives falling within the scope of the invention as defined by the appended claims.

DETAILED DESCRIPTION OF THE PREFERRED EMBODIMENT

Turning now to FIG. 1 of the drawings, there is shown a pinball machine 110 employing the present invention. The pinball machine 100 has a housing 99 in which a main playfield 101 is mounted. The player initially pulls and releases a plunger 103 to project a ball 102 over the playfield 101. During play, the player depresses left and right flipper push-button switches 104, 105 to activate left and right flippers 106, 107 to keep the ball in play.

As shown in FIG. 1, the pinball machine 100 has an elevated playfield section 110 in the shape of an elongated rectangle. As will be further shown in FIG. 3, the playfield section 110 is sufficiently elevated that the ball 102 may pass beneath it when rolling over the main playfield 101, for example, after the player initially pulls and releases the plunger 103 to project the ball over the main playfield 101. Both the main playfield 101 and the elevated playfield section 110 are inclined toward the front of the pinball machine 100. When the ball is on the elevated playfield, it rolls downward and is collected by a vacuum-formed plastic ramp 111. The ramp 111 directs the ball towards the back of the main playfield 101, where the ball exits the ramp 111 and rolls forward over the main playfield and under the elevated playfield section 110.

To elevate the ball from the main playfield 101 to the elevated playfield section 110, the pinball machine 100 includes a ball elevator 120 having a perforated conveyor belt 121 driven by an electric motor 122. The electric motor, for example, is a continuously-excited 120 VAC motor with an internal gear train providing a speed of 30 revolutions per minute. The perforations in the conveyor belt 121 are circular and have an internal diameter that is about 80% of the diameter of the ball. The perforations, for example, have a diameter of between $\frac{3}{4}$ of an inch and $\frac{7}{8}$ ths of an inch, for elevating a ball having a diameter of 1 and 1/16 of an inch. The best size for the perforations depends on the degree of incline of the belt. A relatively large diameter is best for a steep incline, and a relatively small diameter is best for a gradual incline. For the pinball machine as shown in FIG. 1, the diameter of the perforations was chosen to be 0.875 inches.

For the ball to reach the ball elevator 120, the player must activate one of the flippers 106, 107 at the proper time to project the ball to a checkered target 123 at the entrance of a passage 124 directing the ball to the lower end of the conveyor belt 121. The conveyor belt 121 lifts the ball to an elevated vacuum-formed plastic ramp 125 that drops the ball onto the rear portion of the elevated playfield section 110. A metal wire ramp could be used in lieu of the plastic ramp 125.

The elevated playfield section 110 has mounted to it a number of conventional ball-deflecting components and ball-sensing switches. The elevated playfield section 110, however, is not mounted in a fixed position with respect to the housing 99 or the main playfield 101 of the pinball machine 100. Instead, the forward end of the elevated playfield section 110 is pivotally mounted to the main playfield 101, and the rear end of the elevated playfield is mounted for translation in a transverse direction, as will be further described with reference to FIGS. 3, 4 and 5. Moreover, when the ball is on the elevated playfield section 100, the rear end of the elevated playfield section moves toward the right when the player presses the right flipper button 105, and the rear end of the elevated playfield section moves toward the left when the player presses the left flipper button 104. Therefore, the player can inter-actively control the path of the ball when the ball rolls down the elevated playfield section.

The elevated playfield section 110 and the ball elevator 120 are more particularly configured and interconnected in accordance with a particular game theme. For the specific construction shown in FIG. 1, the game theme is down-hill slalom skiing. The ball elevator 120 represents a chair lift, and the elevated playfield 110 represents a hill having a slalom course.

Figure 2:
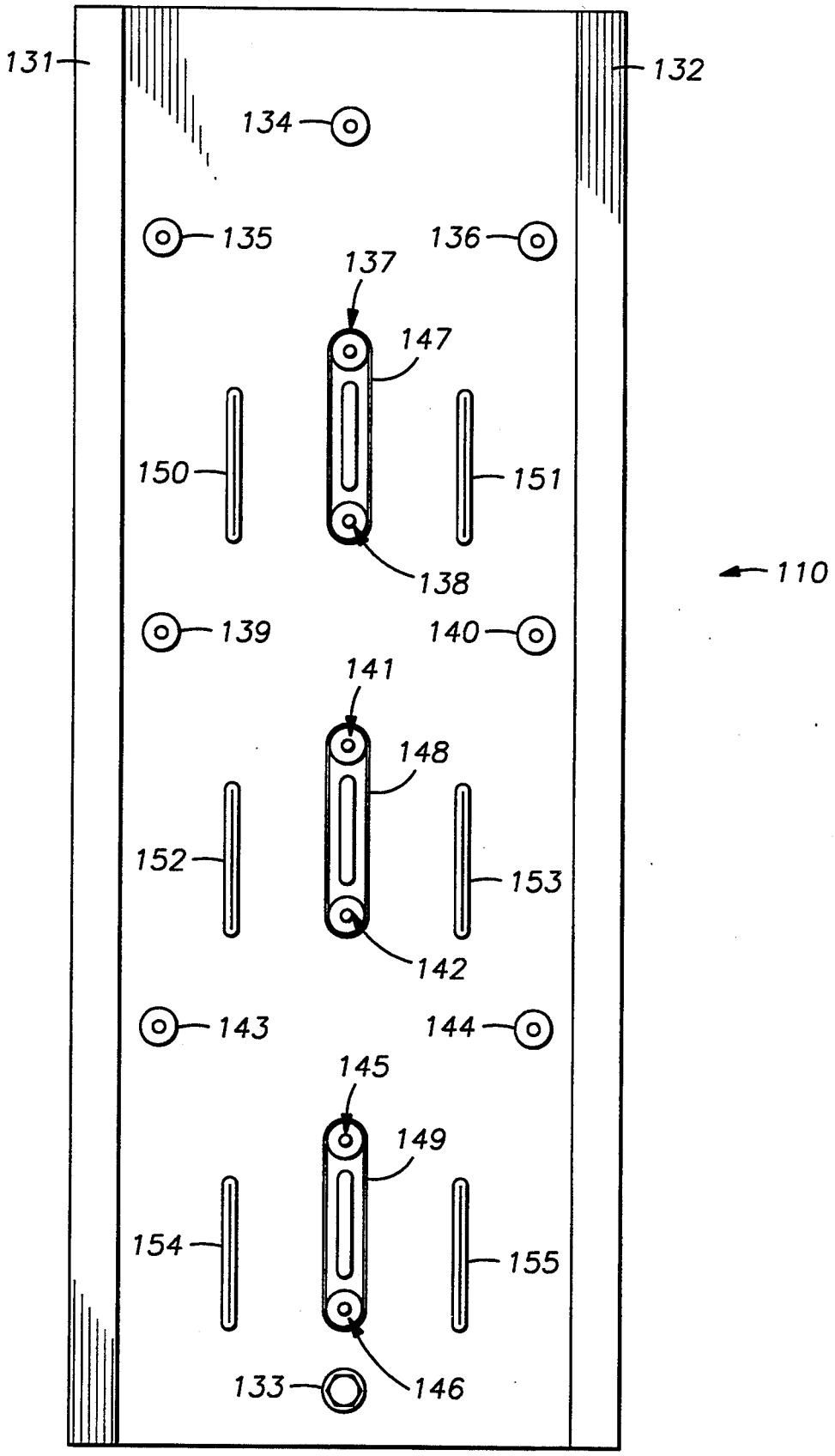
FIG. 2 is a plan view of an elevated interactive playfield section used in the pinball machine of FIG. 1.

Turning now to FIG. 2, there is shown in a plan view of the elevated playfield section 110. To contain the ball, a pair of wood side rails 131, 132 are fastened to the elevated playfield section 110. The front of the elevated playfield section pivots about a screw 133. To deflect the ball, a number of bumpers 134 to 146 are strategically arranged on the elevated playfield 110. Each of these bumpers 134 to 146 has a "minipost" secured to the elevated playfield, and a rubber ring forced onto the "minipost." Plastic lane dividers 147, 148, and 149 are mounted between respective neighboring pairs of the bumpers (137, 138), (141, 142), and (143, 144), so as to create a pair of 1 and $\frac{1}{4}$ inch wide lanes.

Figure 3:
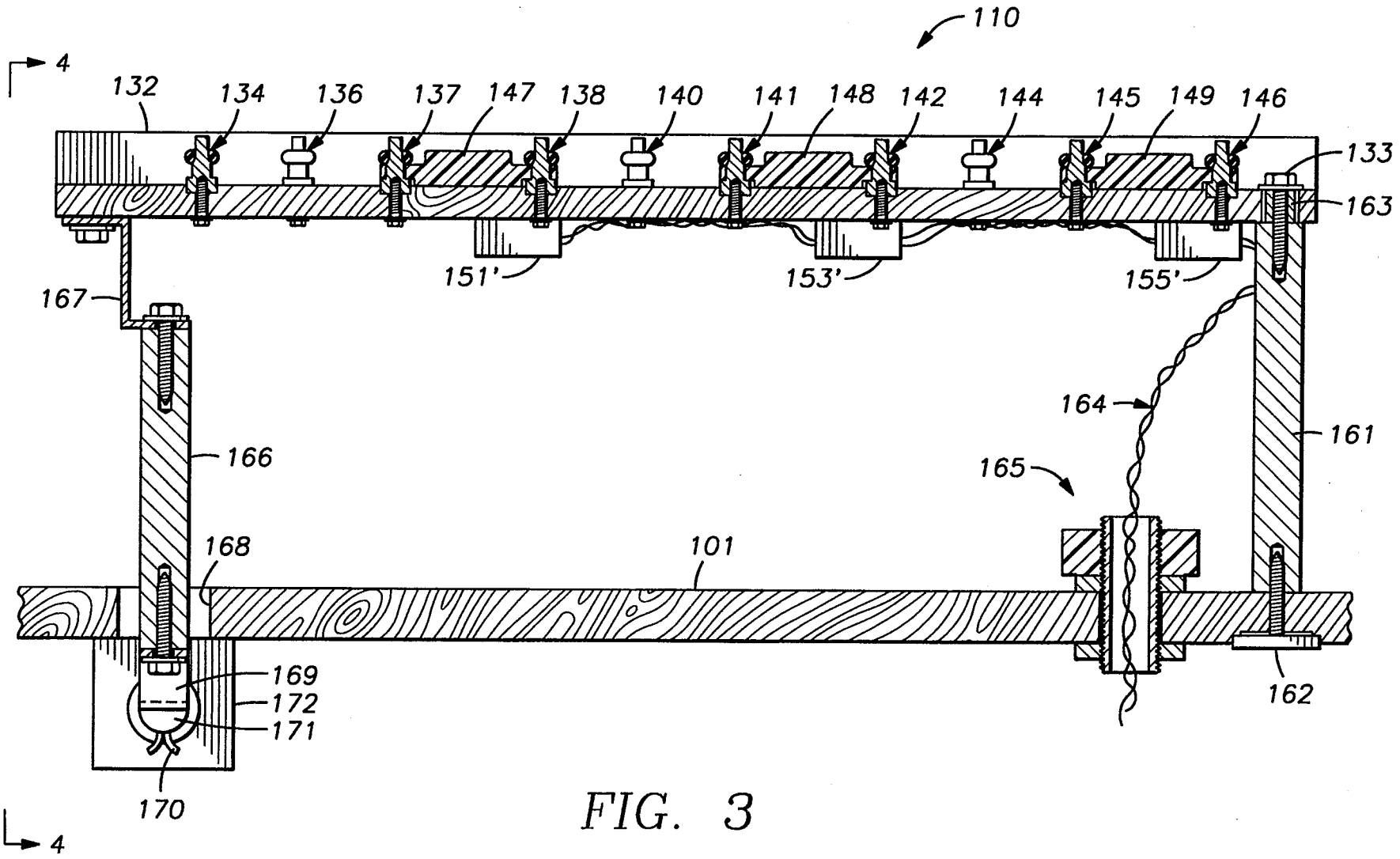
FIG. 3 is a side view, in section along line 3—3 in FIG. 4, of the elevated interactive playfield section of FIG. 2.
Figure 4:
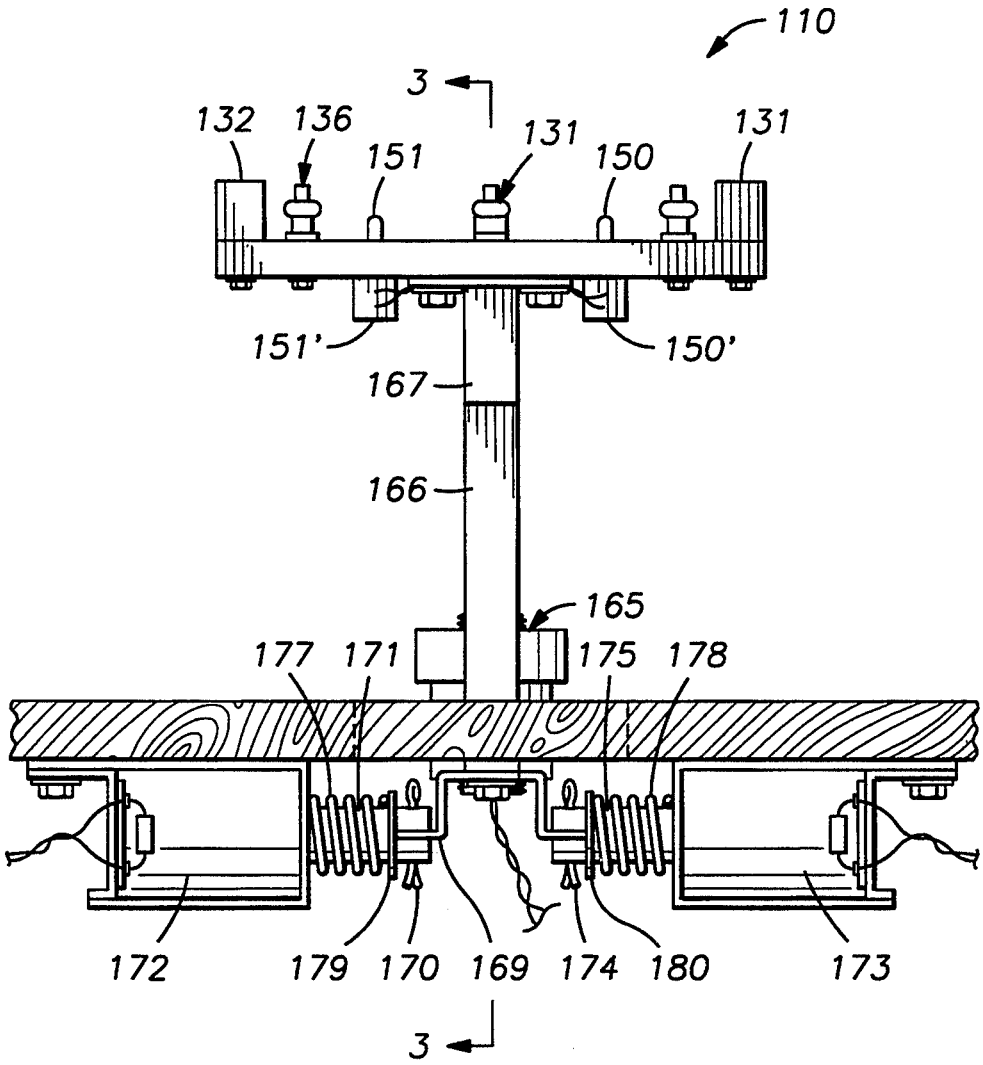
FIG. 4 is a rear end view, in section along line 4—4 in FIG. 3, of the elevated interactive playfield section of FIG. 2.

Wire-forms 150 to 155 extend upward through slots in the elevated playfield section 110 from respective roll-over switches 150' to 155' mounted underneath the elevated playfield section 110 (such as switches 150', 151', 153', and 155' seen in FIGS. 3 and 4). These ball-sensing switches are connected to a microcomputer (201 in FIGS. 7 or 201' in FIG. 8) in order to award the player points for causing the ball to shift lanes. A specific program for performing these functions will be described below with reference to FIG. 9.

Turning now to FIG. 3, there is shown a side view of the elevated playfield section 110 and its mounting to the main playfield 101. The front end of the elevated playfield section 110 is mounted on a pivot standoff 161 that is fixed to the main playfield 101 by a number eight T-nut 162. The pivot standoff runs up through a clearance hole in the elevated playfield section 110 and has a shoulder which supports the elevated playfield section. The elevated playfield section is retained on the pivot standoff 161 by the screw 133. The screw 133 does not clamp the elevated playfield section to the pivot standoff 161. Instead, when the screw 133 is fully tightened, there is a clearance between the bottom of the head of the screw 133 and the top surface of the elevated playfield section. This clearance is set by a spacer 163 that is slightly longer than the thickness of the elevated playfield section. Alternatively, the clearance could be set by set by machining a shoulder onto the pivot standoff 161, so that in effect the spacer 162 would be integral with the pivot standoff, or else the spacer 163 could be eliminated, and the length of the screw 163 and the depth of the hole into which the screw 163 is threaded could be selected to obtain the clearance when the screw 163 is fully tightened. In any case, the elevated playfield section 110 can freely pivot with respect to the pivot standoff 161.

As shown in FIG. 3, wires 164 from the ball-sensing switches 156, 157, 158 are routed toward the pivot stand-off 161 and then pass downward through a hole in the main playfield 101. The ball should not be permitted to strike the wires when the ball rolls over the surface of the main playfield 101. As shown in FIG. 3, for example, the wires pass through the center of a bumper generally designated 165.

As further shown in FIG. 3, the rear end of the elevated playfield 110 is mounted to a working standoff 166 via a mounting plate 167. The working standoff 166 and the pivot standoff 161 can be any desired length. The working standoff 166 passes through a rectangular aperture 168 cut in the main playfield 101, and extends from a link coupler 169. A cotter pin 170 pins the link coupler 169 to the plunger shaft 171 of a solenoid 172.

Figure 5:
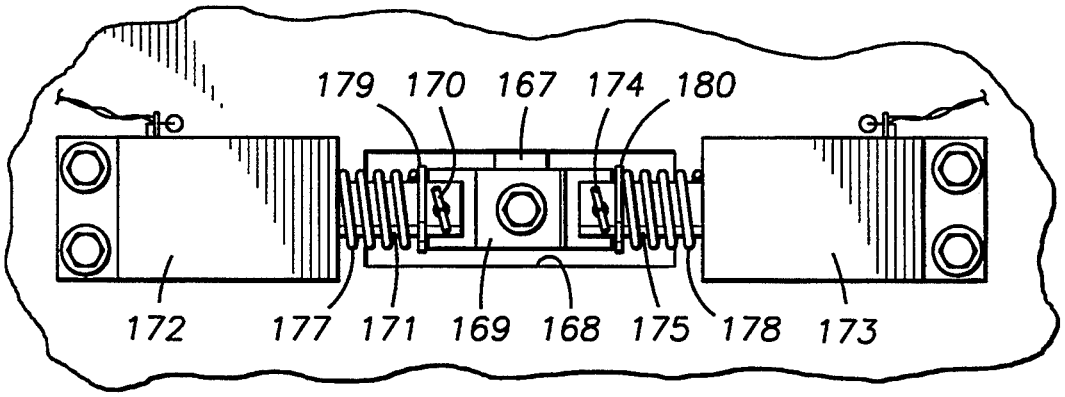
FIG. 5 is a bottom view of solenoids and a linkage to the interactive playfield section of FIG. 2.

The mounting of the link coupler 169 is further shown in the rear end view of FIG. 4, and the bottom view of FIG. 5. A second solenoid 173 is mounted in a coaxial and anti-parallel relationship with respect to the solenoid 172, and a cotter pin 174 pins the link coupler 169 to the plunger shaft 175 of the second solenoid 173. Therefore the working standoff 166 transfers horizontal movement of the solenoid plunger shafts 171, 175 to the elevated play-field 110. Return springs 177, 178 and washers 179, 180 are assembled over the plunger shafts 171, 175 and abut against the link coupler 169 so that the working standoff 166 is disposed in a central position when neither of the solenoids 172, 173 are energized. When one of the solenoids 172, 173 is energized, the working standoff 166 is pulled to the left or right, which moves the elevated playfield section 110 in a desired direction.

Figure 6:
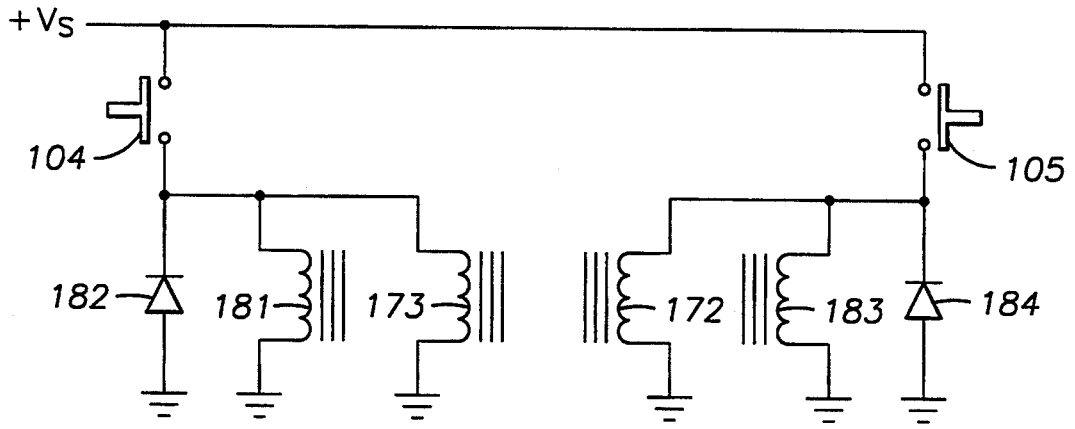
FIG. 6 is a schematic diagram showing a simple method of wiring the solenoids of FIG. 5 to the player-operated flipper switches in the pinball machine of FIG. 1, so that the flipper switches activate both the solenoids of FIG. 5 and the solenoids that actuate the conventional flippers.

Turning now to FIG. 6, there is shown a simple circuit for permitting the player to activate the solenoids 172, 173. The left flipper switch 104 is connected to a solenoid 181 that actuates the left flipper (106 in FIG. 1), and a damper diode 182 that prevents arcing of the switch contacts. In a similar fashion, the right flipper switch 105 is connected to a solenoid 183 that actuates the right flipper (107 in FIG. 1), and a damper diode 184. In the circuit of FIG. 6, the solenoid 172 is wired in parallel with the solenoid 183, and the solenoid 173 is wired in parallel with the solenoid 181. Therefore, each of the flipper switches 104, 105 simultaneously activates one of the flippers 106, 107 and also causes the rear end of the elevated playfield section 110 to be shifted to the left or right.

Figure 7:
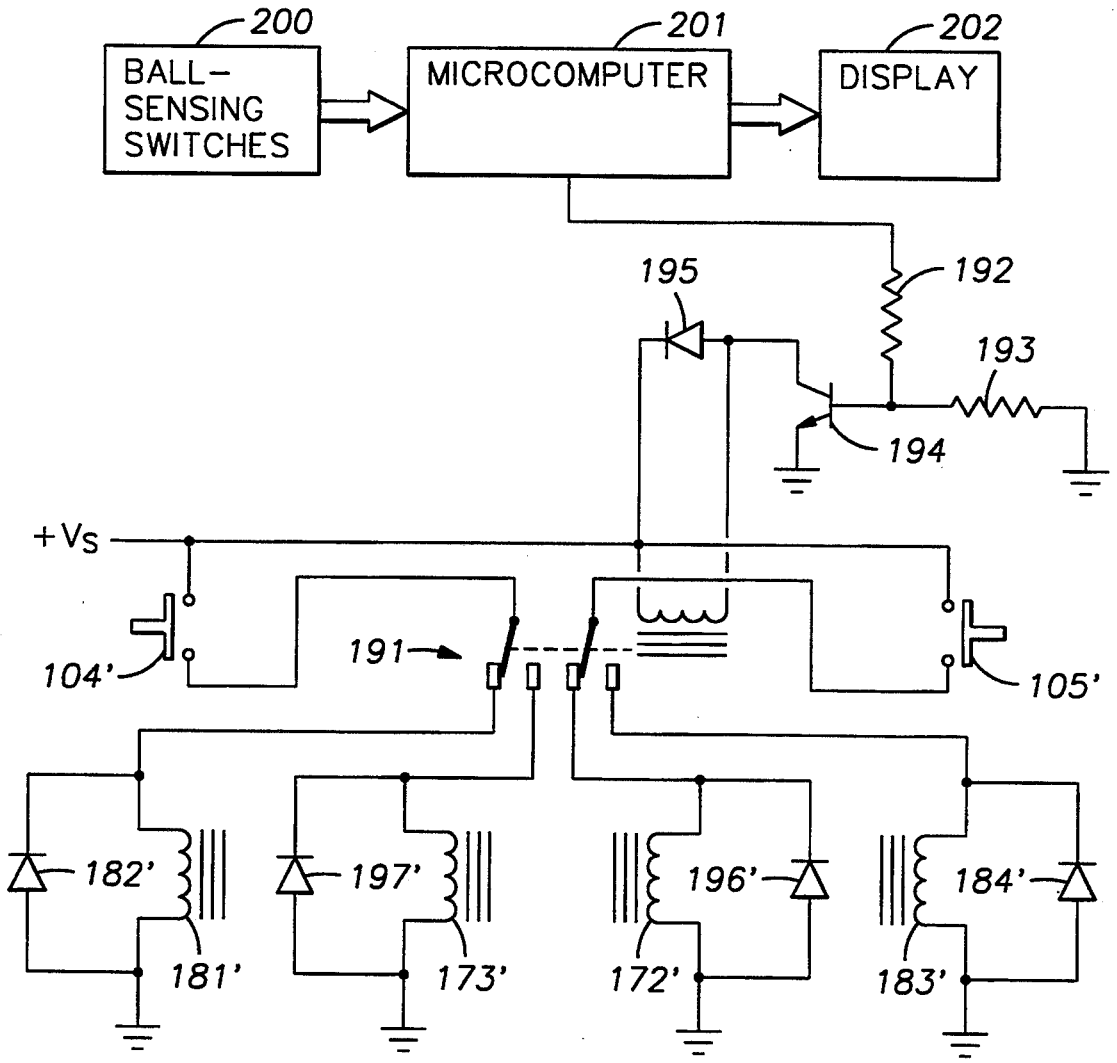
FIG. 7 is a schematic diagram showing an alternative method of wiring the solenoids of FIG. 5 to the player-operated flipper switches, so that the flipper switches activate either the solenoids of FIG. 5 or the solenoids that actuate the conventional flippers.

An alternative circuit is shown in FIG. 7. In this case, a microcomputer 201 operates a double-pole double-throw relay 191 so that the flipper switches 104', 105' activate either the solenoids 181', 183' of the flippers when the relay 191 is not energized, or the solenoids 172', 173' that translate the elevated playfield when the relay 191 is energized. The relay 191 is energized in response to a logic signal from the microcomputer 201. The microcomputer 210 is responsive to ball-sensing switches 200 and operates a display 202 to display the player's score. A ball-sensing switch, for example, senses when the ball passes over the elevated ramp 125 in FIG. 1, and at this time the microcomputer 200 asserts the logic signal that energizes the relay 191. The microcomputer continues to assert the logic signal until the ball closes one of the ball-sensing switches 154' or 155' activated by the wireforms 154 or 155 in FIG. 2 at the lower end of the elevated playfield section 110. The logic signal is applied through a voltage divider including resistors 192 and 193 to a transistor 194 that drives the relay 191. A damper diode 195 protects the transistor 194 when the transistor turns the relay 191 off. Each of the solenoids 181', 183', 172', 173' has a respective damper diode 182', 184', 196', 197' to prevent arcing at the switch and relay contacts.

Figure 8:
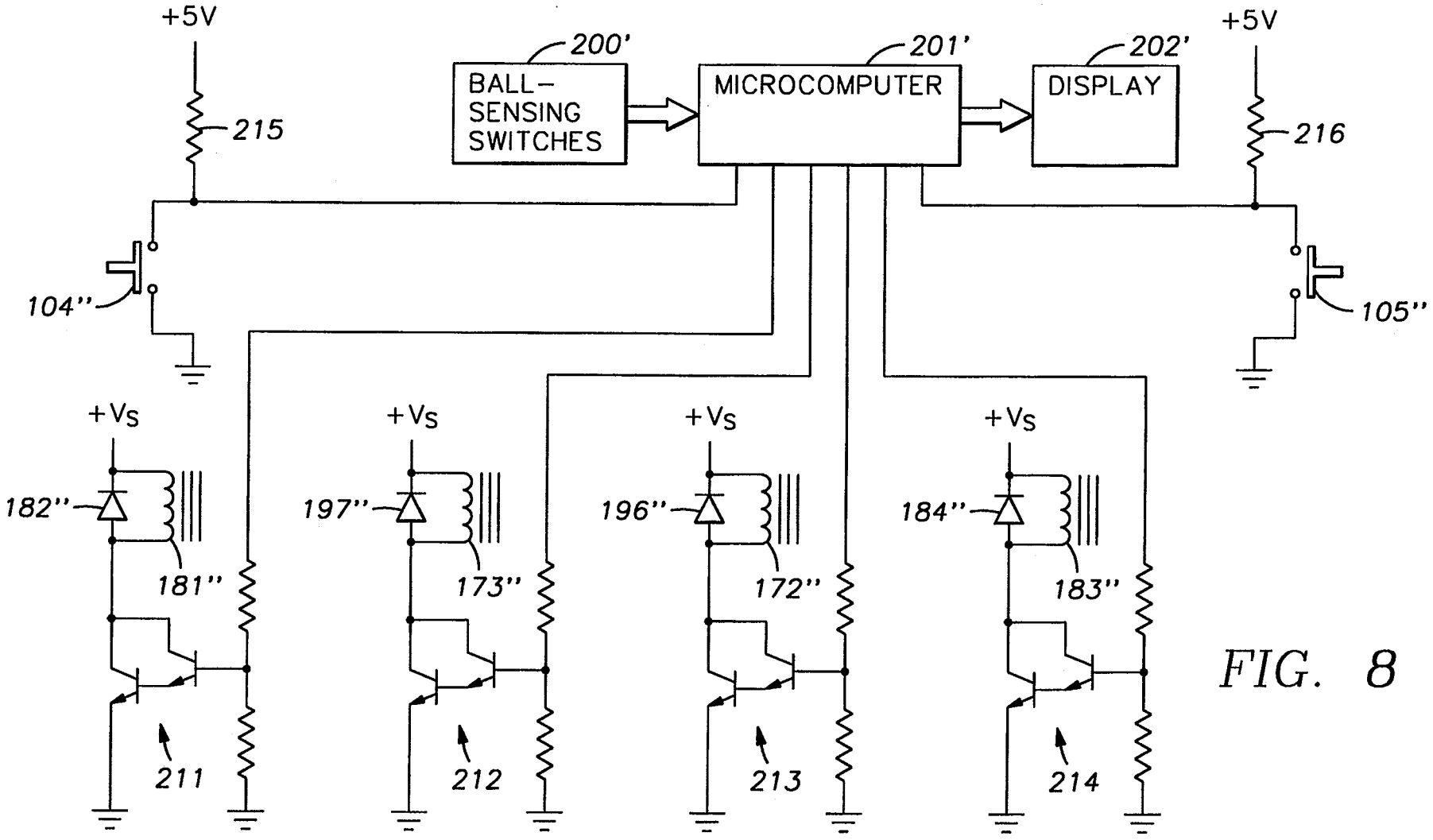
FIG. 8 is a schematic diagram showing yet another method of wiring the solenoids of FIG. 5 to the player-operated flipper switches, so that a microcomputer independently activates the solenoids of FIG. 5 or the solenoids that actuate the conventional flippers.

Yet another alternative circuit is shown in FIG. 8. In this circuit, a microcomputer 201' independently operates each of the flipper solenoids 181'', 183'' and the solenoids 172'', 173'' which translate the elevated playfield. The microcomputer 201' generates a respective logic signal applied to a respective Darlington transistor 211, 212, 213, 214, for driving each of the solenoids 181'', 173'', 172'', 183''. A pull-up resistor 215 is used in connection with the left flipper switch 104'' to provide a player-input logic signal to the microcomputer 201', and a pull-up resistor 216 is used in connection with the right flipper switch 105'' to provide another player-input logic signal to the microcomputer 201'. The microcomputer is also responsive to ball-sensing switches 200' for operating a display 202' to display a player's score, and can be programmed to perform the logic function of the relay 191 in FIG. 7. In addition, the microcomputer can be programmed to independently translate the elevated playfield section 106 during a game sequence. For example, at the start of a game, the microcomputer 201' could move the rear end of the elevated playfield section from side-to-side to attract the player's attention.

Other alternative circuits could be used for activating the solenoids 172, 173 of FIG. 5 with the flipper switches 104, 105. For example, the flipper switches 104, 105 could be directly wired to the flipper solenoids 181, 183 as shown in FIG. 6, but the microcomputer (201 in FIG. 8) could sense the voltage across the flipper solenoids 181, 183 and independently activate the solenoids 172, 173 of FIG. 5 using transistor driver circuits as shown in FIG. 8.

Figure 9:
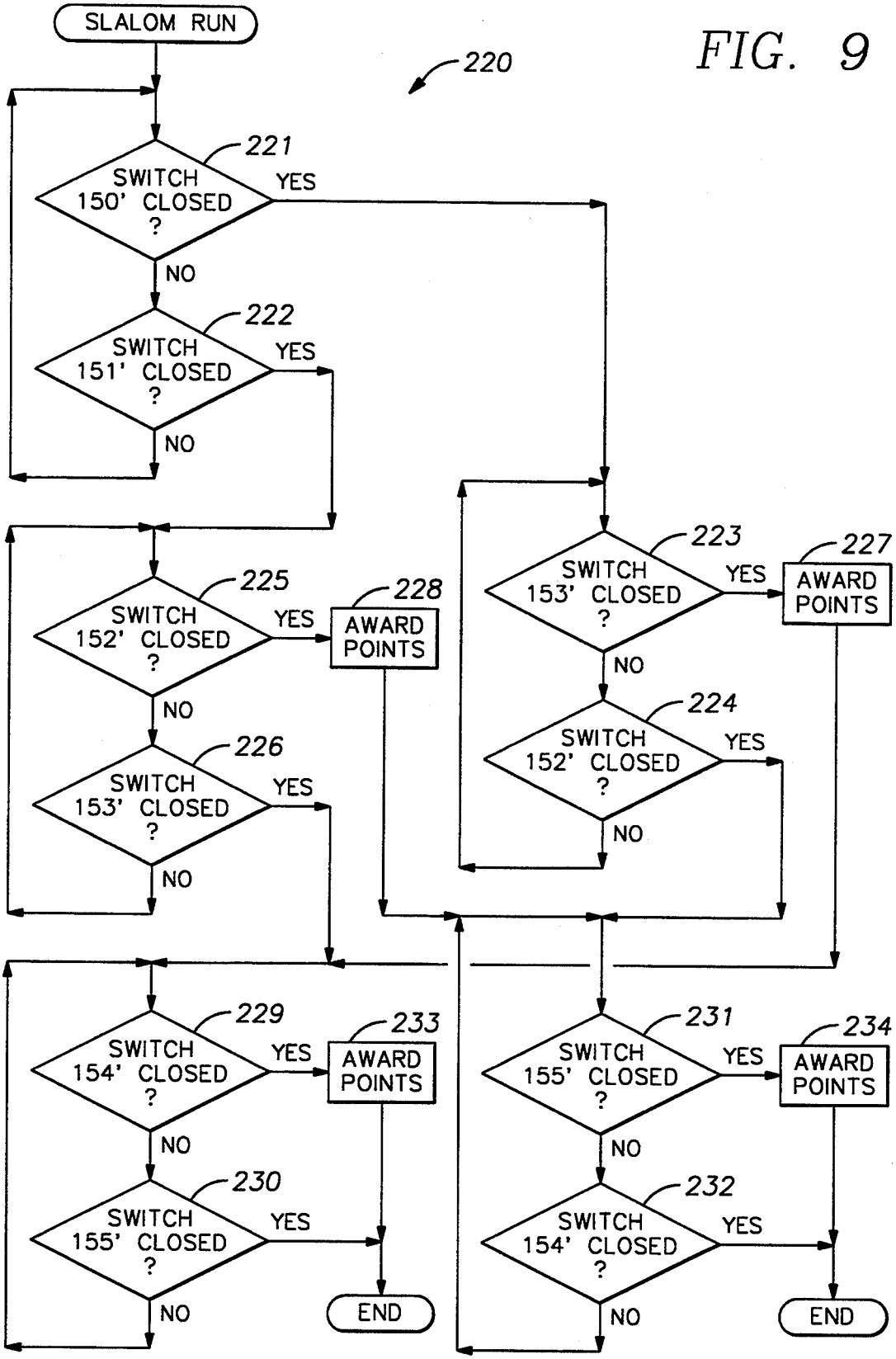
FIG. 9 is a flowchart of a program for awarding points to a player in response to ball-sending switches on the elevated playfield section of FIG. 2.

Turning now to FIG. 9, there is shown a flowchart generally designated 220 of programming for the microcomputer (201 in FIG. 7 or 201' in FIG. 8) to award the player points for causing the ball to shift between the lanes in the elevated playfield section 110 of FIG. 2. In the first steps 221 and 222, the microcomputer scans the switches 150' and 151' activated by the wire-forms 150 and 151 of FIG. 2 until the microcomputer finds that one of the switches is closed. When the microcomputer finds that the switch 150' is closed, in steps 223 and 224 the microcomputer scans the switches 153' and 152' activated by the wire-forms 153 and 152 in FIG. 2. When the microcomputer finds that the switch 151' is closed, the microcomputer also scans the switches 152' and 153', but in different steps 225 and 226. If switch 153' is found to be closed in step 223, then in step 227 the player is awarded points, because the ball has shifted lanes from the wireform 150 to the wire-form 153 in FIG. 2. In a similar fashion, if switch 152' is found to be closed in step 225, then in step 228 the player is awarded points, because the ball has shifted lanes from the wireform 151 to the wireform 152 in FIG. 2.

When the microcomputer finds in step 226 that the switch 153' is closed, and after step 227, the microcomputer scans in steps 229 and 230 the switches 154' and 155' activated by the wire-forms 154 and 155 in FIG. 2. When the microcomputer finds in step 224 that the switch 152' is closed, and after step 228, the microcomputer also scans the switches 154' and 155', but in steps 232 and 231. If the microcomputer finds in step 229 that the switch 154' is closed, then in step 233 the player is awarded points, because the ball has shifted lanes from the wire-form 153 to the wire-form 154 of FIG. 2. If the microcomputer finds in step 230 that the switch 155' is closed, or after step 233, the "slalom run" is finished, and execution may return to steps 221 and 222 after the microcomputer performs other game functions. If the microcomputer finds in step 231 that the switch 155' is closed, then in step 234 the player is awarded points, because the ball has shifted lanes from the wire-form 152 to the wire-form 155 in FIG. 2. If the microcomputer finds in step 232 that the switch 154' is closed, or after step 234, the "slalom run" is finished, and execution may return to steps 221 and 222 after the microcomputer performs other game functions.

Figure 10:
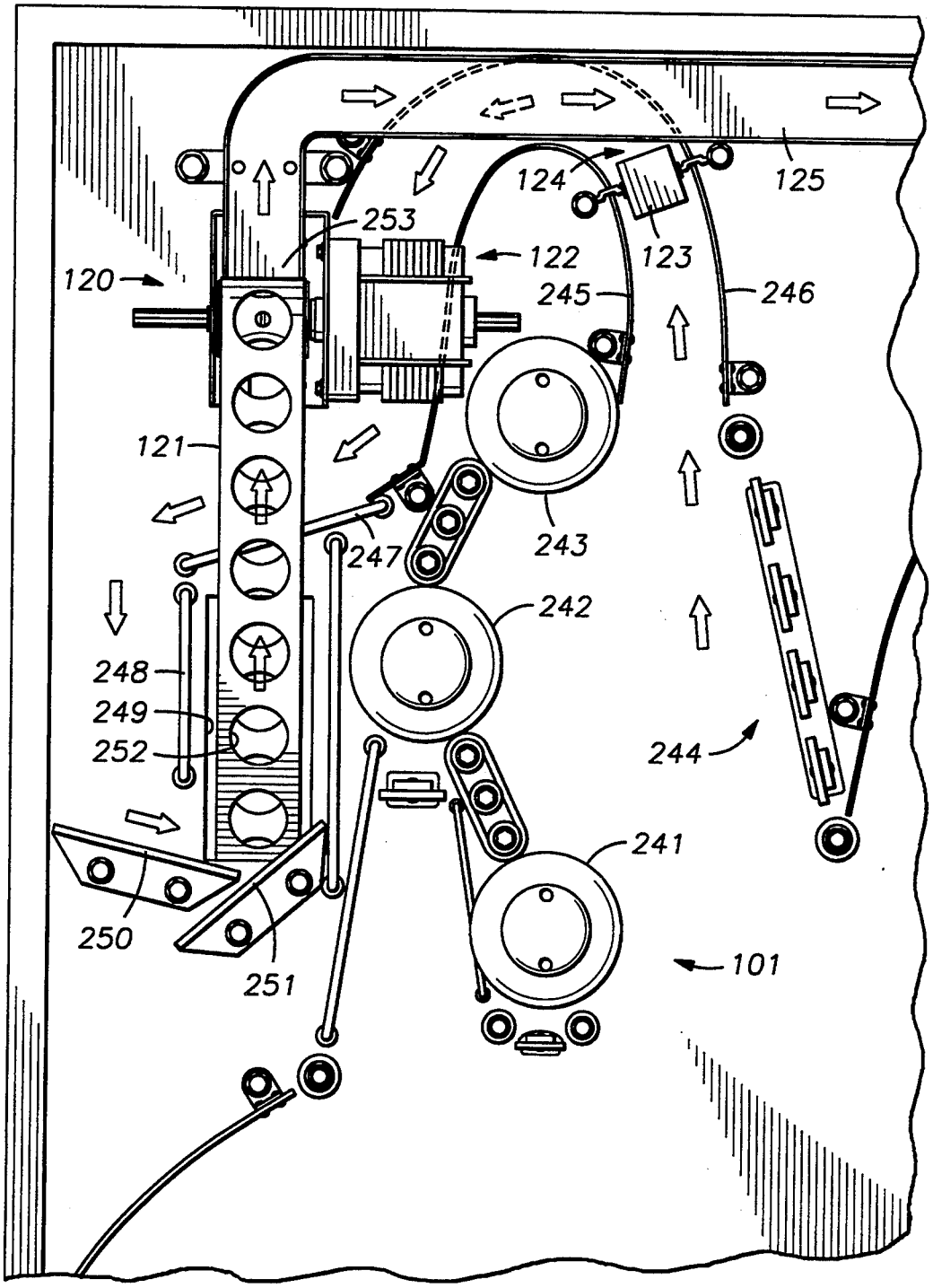
FIG. 10 is a plan view of an upper-left portion of the playfield in the pinball machine of FIG. 1, showing a conveyor belt for elevating the ball from the main playfield to the elevated playfield section of FIG. 2.

Turning now to FIG. 10, the ball elevator 120 is shown in greater detail in a plan view of an upper-left portion of the main playfield 101 in the pinball machine of FIG. 1. The path of the ball to and from the ball elevator 120 is depicted by a series of heavy arrows in FIG. 10.

To reach the ball elevator 120, the ball is projected by one of the flippers (106, 107 in FIG. 1) toward a checkered flag 123. The ball passes between a set of bumper targets 241, 242, 243 and a bank of stationary targets generally designated 244. The ball is received between a pair of curved metal guide strips 245, 246 forming a U-shaped channel 124 under the checkered flag 123, under the elevated vacuum-formed plastic ramp 125, and under the motor 122 of the ball elevator 120. A wire rail 247 guides the ball under the conveyor belt 121 of the ball elevator 120. The wire rail 247 and a wire rail 248 also prevent the ball from falling through a rectangular aperture 249 in the main playfield 101 through which the conveyor belt 121 passes.

A pair of brackets 250 and 251 guide the ball to fall into the lower end of the aperture 249 where the ball sits on the conveyor belt 121 until the ball is captured in a circular hole in the conveyor belt, such as the hole 252. The conveyor belt 121 then raises the ball up to an exit location 253 at the beginning of the elevated vacuum-formed plastic ramp 125, and the ball rolls down the ramp 125 toward the right, to be dropped onto the upper end of the elevated playfield section 110 shown in FIG. 1.

Figure 11:
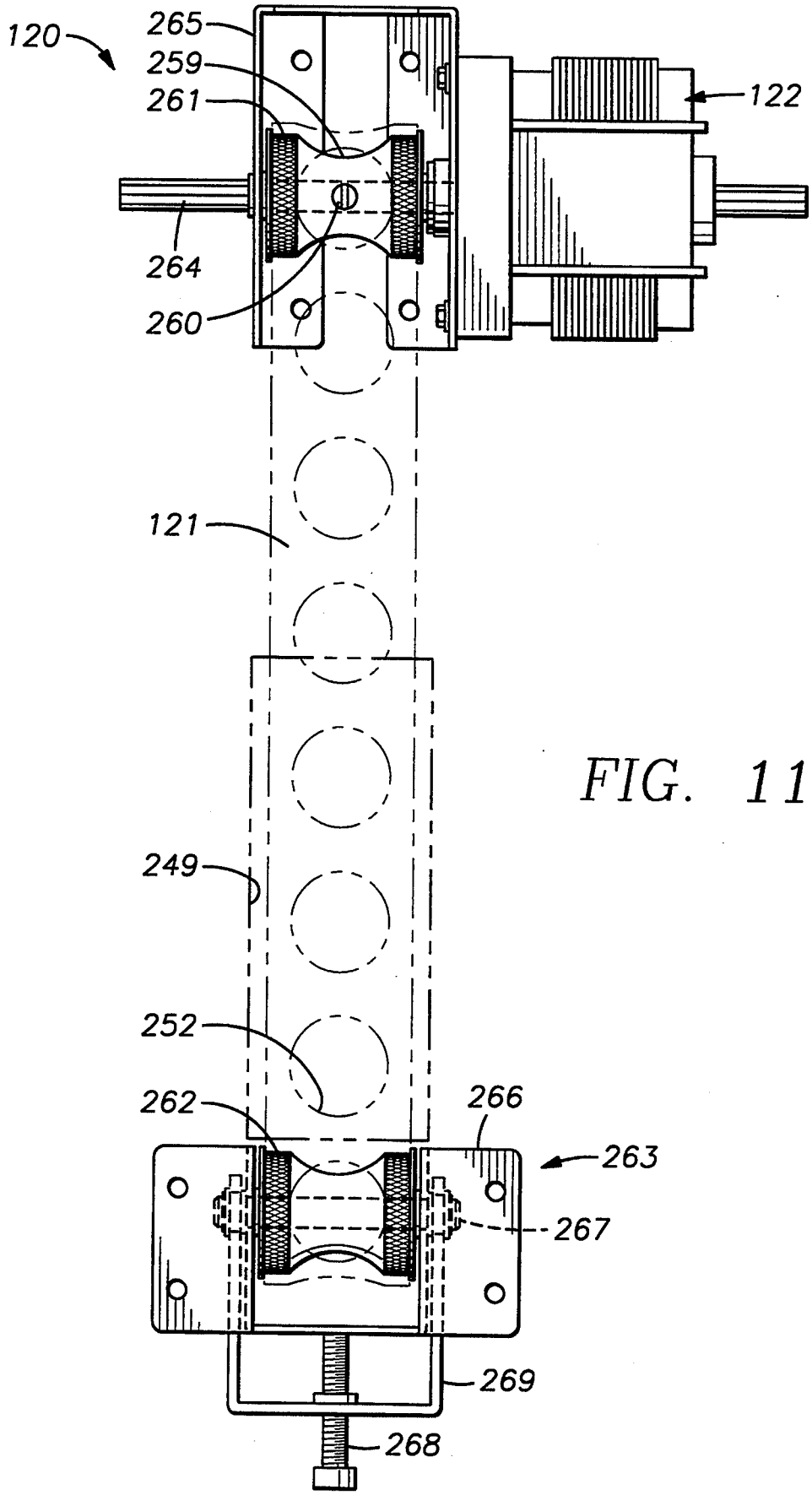
FIG. 11 is a plan view of the conveyor belt mechanism of FIG. 10, in which the belt and the main playfield are shown in phantom lines to expose the belt pulleys and the lower pulley assembly which is mounted underneath the main playfield.

Turning now to FIG. 11, there is shown a plan view of the conveyor belt mechanism of FIG. 10, in which the belt 121 and the aperture 249 of the main playfield are shown in phantom lines to expose the belt pulleys 261, 262 and the lower pulley assembly 263 which is mounted underneath the main playfield. A set screw 260 secures the upper pulley 261 to the shaft 264 of the motor 122. The motor 122 is mounted to the main playfield by a bracket 265 formed from sheet metal.

The upper pulley 261 has a central concave region 259 to prevent the upper pulley from prematurely ejecting the ball from the belt when the ball reaches the upper pulley. The upper pulley 261 is machined from aluminum, and the circumferential portions of the upper pulley, which contact the belt 121, are knurled to prevent the belt from slipping with respect to the upper pulley. For convenience, the lower pulley 262 is identical to the upper pulley.

The belt 121 preferably consists of molded polyurethane and polyester cord, and has an elasticity of about 80 to 85 derometer. The belt 121 is manufactured by cutting a strip to length, perforating the strip, and welding the ends of the strip together to form a continuous band. The belt can be purchased from Voss Belting & Specialties, 6965 North Hamlin Avenue, Lincolnwood, Ill. 60645.

The lower pulley assembly also has a sheet metal mounting bracket 266. The lower pulley 262 is mounted on a shaft 267 for free rotation with respect to its mounting bracket 266. In addition, the shaft 267 can translate forward and backward with respect to the mounting bracket 266 for tensioning the belt 121. The belt tension is adjusted by a screw 268 that abuts the mounting bracket 266 and is threaded to a U-shaped fork that pulls on the end of the shaft 267.

Figures 12, 13:
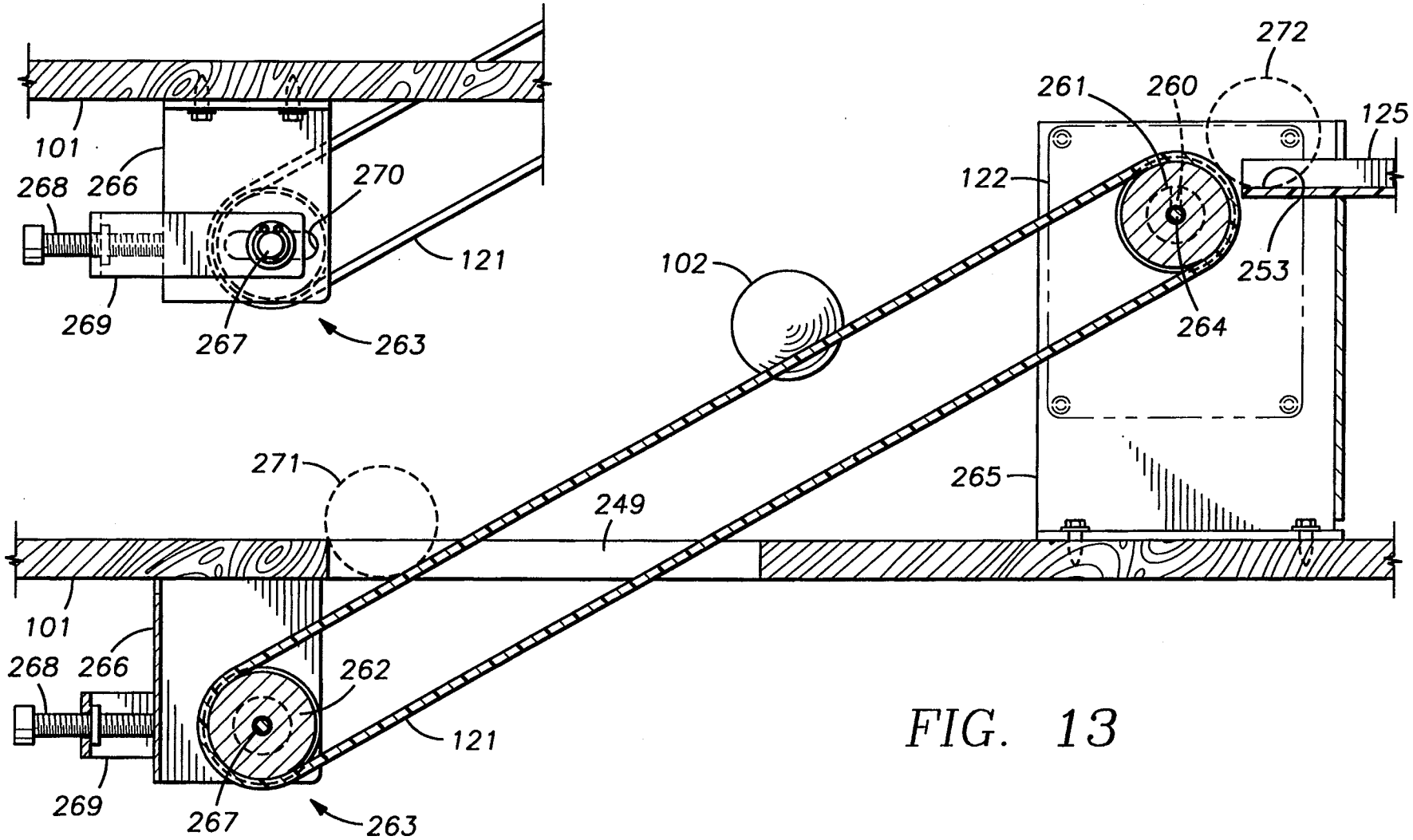
FIG. 12 is a side view of the lower pulley assembly.
FIG. 13 is a side view of the conveyor belt mechanism of FIG. 11, in cross-section, to illustrate the entrance and exit of a ball being elevated.

Turning now to FIG. 12, there is shown a side view of the lower pulley assembly 263. The mounting bracket 266 is screwed to the underside of the main playfield 101. To permit the shaft 267 to translate with respect to the mounting bracket 266 for adjustment of the belt tension, the near end of the shaft 267 passes through a horizontal slot 270 cut in the mounting bracket 163. The far end of the shaft 267 passes through a similar horizontal slot cut in the opposite side of the mounting bracket 266.

Turning now to FIG. 13, there is shown a side view of the conveyor belt mechanism of FIG. 11, in cross-section, to illustrate the entrance and exit of the ball 102 being elevated. At an entrance position 271 shown in phantom lines, the ball sits on the belt 121 and a rear wall of the rectangular aperture 249. At an exit position 272 shown in phantom lines, the ball is tangent to the outer surface of the belt 121 around the upper pulley 261, and the ball is also tangent to the upper surface of the elevated ramp 125 at an entrance point 253 on the ramp. The ball 102 passes above and over the upper pulley 261 when being conveyed by the conveyor belt 121 from the entrance position 271 to the exit position 272. Also shown in FIG. 13, in phantom lines is an outline of the motor 122, which is raised off of the main playfield 101 to permit the ball to roll underneath the motor.

In view of the above, there has been described a ball elevator in a pinball game, in which the pinball is elevated by a conveyor belt from an entrance location to an exit location. The ball elevator is reliable and easy to manufacture. The path of the ball is visible to the player, for maintaining player interest during the time required to lift the ball. Moreover, the ball elevator has an appearance that is in accordance with a game theme.

What is claimed is:

1. A pinball machine comprising, in combination:
a housing;
a playfield mounted in said housing for supporting a rolling pinball; and
a ball elevator; said ball elevator including an inclined conveyor belt mounted in said housing for elevating said pinball from an entrance location to an exit location, and a motor coupled to said conveyor belt for driving said conveyor belt to elevate said pinball.

2. The pinball machine as claimed in claim 1, wherein said conveyor belt is an endless strip of flexible material.

3. The pinball machine as claimed in claim 2, wherein said conveyor belt is perforated with apertures for receiving said pinball.

4. The pinball machine as claimed in claim 3, wherein said apertures are circular and have a diameter less than the diameter of said pinball.

5. The pinball machine as claimed in claim 4, wherein said perforations have a diameter of about 80% of the diameter of said pinball.

6. The pinball machine as claimed in claim 2, wherein said conveyor belt is tensioned between an upper pulley and a lower pulley, and one of said upper pulley and said lower pulley is driven by said motor.

7. The pinball machine as claimed in claim 6, wherein said exit location is a location reached when said pinball is raised over and passes over said upper pulley.

8. The pinball machine as claimed in claim 7, wherein said conveyor belt is perforated with apertures for receiving said pinball, and said upper pulley has a central concave region to prevent said upper pulley from prematurely ejecting said pinball from said conveyor belt when said pinball reaches said upper pulley.

9. The pinball machine as claimed in claim 6, further including means for adjusting the tension of said conveyor belt.

10. A pinball machine comprising, in combination:

a playfield having a plurality of ball-deflecting components mounted thereon;

means for projecting a pinball over said playfield;

an inclined conveyor belt for elevating said pinball from a predefined entrance location to a predefined exit location, said conveyor belt being an endless band of flexible material, said conveyor belt having a series of spaced aperture for receiving said pinball, said conveyor belt being tensioned between two pulleys, a lower one of said pulleys being rotatably mounted to said playfield at a location below said playfield, and an upper one of said pulleys being rotatably mounted to said playfield at a location above said playfield; and an electric motor mounted to said playfield and having a shaft coupled to one of said pulleys for driving said conveyor belt to elevate said pinball.

11. The pinball machine as claimed in claim 10, wherein said spaced apertures are circular, and have a diameter of about 80% of the diameter of said pinball.

12. The pinball machine as claimed in claim 10, wherein, at said entrance location, said pinball rests on said conveyor belt and a surface of said playfield defining an aperture in said playfield through which said conveyor belt passes.

13. The pinball machine as claimed in claim 10, wherein said exit location is reached when said pinball is raised over and passes over said upper pulley, and said upper pulley has a central concave region to prevent said upper pulley from prematurely ejecting said pinball from said conveyor belt when said pinball reaches said upper pulley.

14. The pinball machine as claimed in claim 10, further including means for adjusting the tension of said conveyor belt.

15. A method for elevating a pinball in a pinball machine, said method including the steps of:

(a) driving an inclined conveyor belt with a motor, said conveyor belt having a series of spaced apertures for receiving said pinball;

(b) directing said pinball to a predefined entrance position where said pinball becomes engaged by one of said apertures in said conveyor belt and elevated by movement of said belt; and (c) receiving said pinball from said conveyor belt at a predefined exit position that is elevated with respect to said entrance position.

16. The method as claimed in claim 1, wherein said conveyor belt is tensioned between a pair of pulleys, and further comprising the step of turning a screw to adjust spacing between said pulleys to tension said conveyor belt.

* * * * *